US006893242B2

(12) United States Patent
Yang et al.

(10) Patent No.: US 6,893,242 B2
(45) Date of Patent: May 17, 2005

(54) COMPRESSOR WITH Z-PLATE

(75) Inventors: Kwang-Sik Yang, Changwon (KR); Bum-Dong Sa, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/380,324

(22) PCT Filed: Nov. 19, 2002

(86) PCT No.: PCT/KR02/02160

§ 371 (c)(1),
(2), (4) Date: Mar. 13, 2003

(87) PCT Pub. No.: WO03/044371

PCT Pub. Date: May 30, 2003

(65) Prior Publication Data

US 2004/0109779 A1 Jun. 10, 2004

(30) Foreign Application Priority Data

Nov. 20, 2001 (KR) ..... 2001-72413
Dec. 13, 2001 (KR) ..... 2001-78997

(51) Int. Cl.[7] ..... F03C 2/00
(52) U.S. Cl. ..... 418/216; 418/60; 418/63; 418/217

(58) Field of Search ..... 418/63, 60, 216, 418/217

(56) References Cited

U.S. PATENT DOCUMENTS 805,140 A * 11/1905 Jarvis ..... 418/216
1,690,728 A * 11/1928 Jaworowski ..... 418/216
4,575,324 A * 3/1986 Sommer et al. ..... 418/217

* cited by examiner

*Primary Examiner*—Theresa Trieu
(74) *Attorney, Agent, or Firm*—Fleshner & Kim, LLP

(57) ABSTRACT

A compressor is provided which minimizes impact noise and abrasion between a Z-plate of the compressor and vanes formed in the compressor. Ends of the vanes formed in the compressor contact sides of the Z-plate, and the motion and surface configuration of the Z-plate cause the vanes to move reciprocally and to section compression spaces within the compressor into a suction area and a compression area. Due to the curvature of the surfaces of the Z-plate, the vanes remain in constant contact with the surface of the Z-plate, which allows for smooth transition phases and a subsequent reduction in impact noise and abrasion between the vanes and the Z-plate.

7 Claims, 4 Drawing Sheets

COMPRESSOR WITH Z-PLATE

TECHNICAL FIELD

The present invention relates to a compressor with a Z-plate, a kind of rotary compressor, and, more particularly, to a compressor with a Z-plate in which a plane portion provided at both top dead centers of a Z-plate meet other curved portion with a curved line.

BACKGROUND ART

In general, a compressor is a device for converting a mechanical energy into a compression energy of a fluid. And, depending on a compression method, a freezing compressor is classified into a reciprocating compressor, a scroll compressor, a centrifugal compressor and a rotary compressor.

The applicant of the present invention has filed an application for a development of a compressor with Z-plate with a novel conception, that can be classified as a rotary compressor, which was laid open on May 7, 2001 with a Korean Patent Publication No. 2001-0035687.

The compressor with a Z-plate in accordance with a conventional art will now be described with reference to FIG. 1.

The conventional compressor with a Z-plate includes an electric mechanism unit consisting of a stator (Ms) and a rotor (Mr) which generate a driving force at an upper portion inside a casing 1 and a compression mechanism unit connected to the rotor (Mr) and sucking, compressing and discharging a fluid.

The compression mechanism unit includes a cylinder 2 fixed at a lower portion of the casing 1, first and second bearing plates 3A and 3B fixed at an upper face and a lower face of the cylinder 2 and forming an inner space of the cylinder 2, a rotational shaft 4 coupled at the rotor (Mr) of the electric mechanism unit and penetratingly coupled at the bearing plates 3A and 3B to transfer a driving force of the electric mechanism unit to the compression mechanism unit, a Z-plate 5 coupled at the rotational shaft 4 or integrally molded to section the inner space of the cylinder 2 into first space (S1) and second space (S2), first and second vanes 6A and 6B of which a lower end and an upper end is respectively in contact with both faces of the Z-plate 5 so as to section each space S1 and S2 into a suction area and a compression area when the rotational shaft 4 is rotated, and first and second spring assemblies 8A and 8B for elastically supporting the vanes 6A and 6B.

With reference to FIG. 2, the Z-plate 5 is formed as a disk type in view of a plane projection so that its outer circumferential face can slidably contact an inner circumferential face of the cylinder 2. When unfolded, the side of the Z-plate 5 forms a curved portion 5*a* in a sine wave shape.

Both top dead center portions of the Z-plate 5 are in contact with each bearing face of the first bearing plate 3A and the second bearing plate 3B, and the contact portion forms a plane portion 5*b* so as to enlarge a sealing area by being in surface-contact with the bearing faces of each of the bearing plates 3A and 3B.

The first vane 6A and the second vane 6B are formed as a rectangular parallelepiped, of which each upper end is supported by the spring assemblies 8A and 8B and each lower end penetrates each of the bearing plates 3A and 3B so as to be in contact with both upper and lower sides of the Z-plate 5.

In FIG. 1, reference numerals 2*a* and 2*b* are suction passage of each space, 3*a* and 3*b* are discharge passages, 7A and 7B are discharge mufflers, 7*a* and 7*b* are discharge holes, DP is a discharge pipe, and SP is a suction pipe.

The compressor with the Z-plate in accordance with the conventional art is operated as follows.

When the rotor (Mr) is rotated as power is applied to the electric mechanism unit, the rotational shaft 4 coupled at the rotor (Mr) is rotated in one direction together with the Z-plate 5, and the vanes 6A and 6B being in contact with both upper and lower sides of the Z-plate are reciprocating in the opposite direction, varying a capacity of the first space S1 and the second space S2. In line with this, a fresh fluid is simultaneously sucked through each of suction passages 2*a* and 2*b* of the first space S1 and the second space S2, gradually compressed and then discharged through the discharge passages 3*a* and 3*b* of the spaces S1 and S2 at the instant when the upper dead center or the lower dead center of the Z-plate 5 reaches the discharge initiation point.

However, in the compressor with the Z-plate in accordance with the conventional art, the portion (θ1, θ2) where the curved portion 5*a* and the plane portion 5*b* of the Z-plate 5 meet each other is formed with an edge, so that when the vanes 6A and 6B behave, a minute lifting phenomenon occurs, causing a fluid leakage and an impact noise.

In addition, as the edge portion where the curved portion 5*a* and the plane portion 5*b* meet contacts the contact surface of the vanes 6A and 6B or contacts the bearing surface of the bearing plates 3A and 3B, an abrasion occurs due to scratch, and in worst case, a crack is generated between both spaces centering around the plane portion 5*b*, which would cause a compressed fluid leakage. This would result in a degradation of a compression performance.

DISCLOSURE OF THE INVENTION

Therefore, an object of the present invention is to provide a compressor with a Z-plate that is capable of preventing abrasion of a vane or a bearing plate as well as a fluid leakage or an impact noise by stabilizing a behavior of the vane being in contact with a Z-plate, thereby promoting improvement of performance of a compressor.

To achieve these and other advantages and in accordance with the purpose of the present invention, as embodied and broadly described herein, there is provided a compressor with a Z-plate having a cylinder with a suction passage and a discharge passage, a Z-plate sectioning an inner space of the cylinder into a plurality of compression spaces and being rotated by a driving unit so that a fluid can be sucked, compressed and discharged, and vanes moved reciprocally by being in contact with both sides of the Z-plate to thereby suction the compression space into a suction area and a compression area, wherein the Z-plate includes a curved portion formed with a particular function for the both sides being in contact with the vane, a plane portion formed around an inflection point of the curved portion including the inflection point, and a gentle portion formed round between the curved portion and the plane portion.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

MODES FOR CARRYING OUT THE PREFERRED EMBODIMENTS

Reference will now be made in detail to the preferred embodiments of the present invention, examples of which are illustrated in the accompanying drawings.

Figure 4:
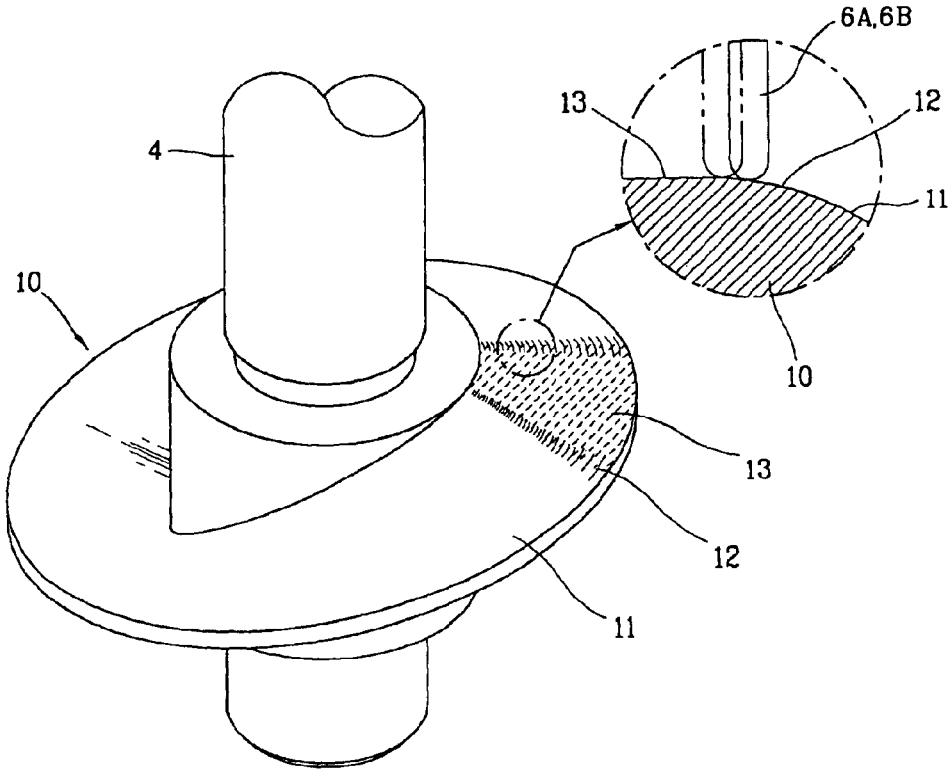
FIG. 4 is a perspective view of a Z-plate of a compressor with a Z-plate in accordance with the present invention.
Figure 5:
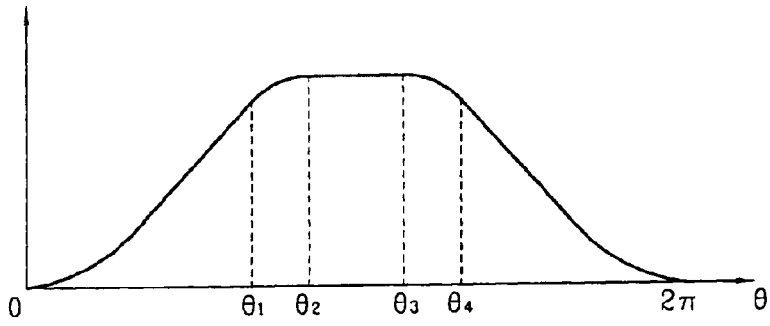
FIG. 5 is a graph showing a development of a cam surface of the Z-plate of the compressor in accordance with the present invention.

FIG. 4 is a perspective view of a Z-plate of a compressor with a Z-plate in accordance with the present invention, and FIG. 5 is a graph showing a development of a cam surface of the Z-plate of the compressor in accordance with the present invention.

Figure 1:
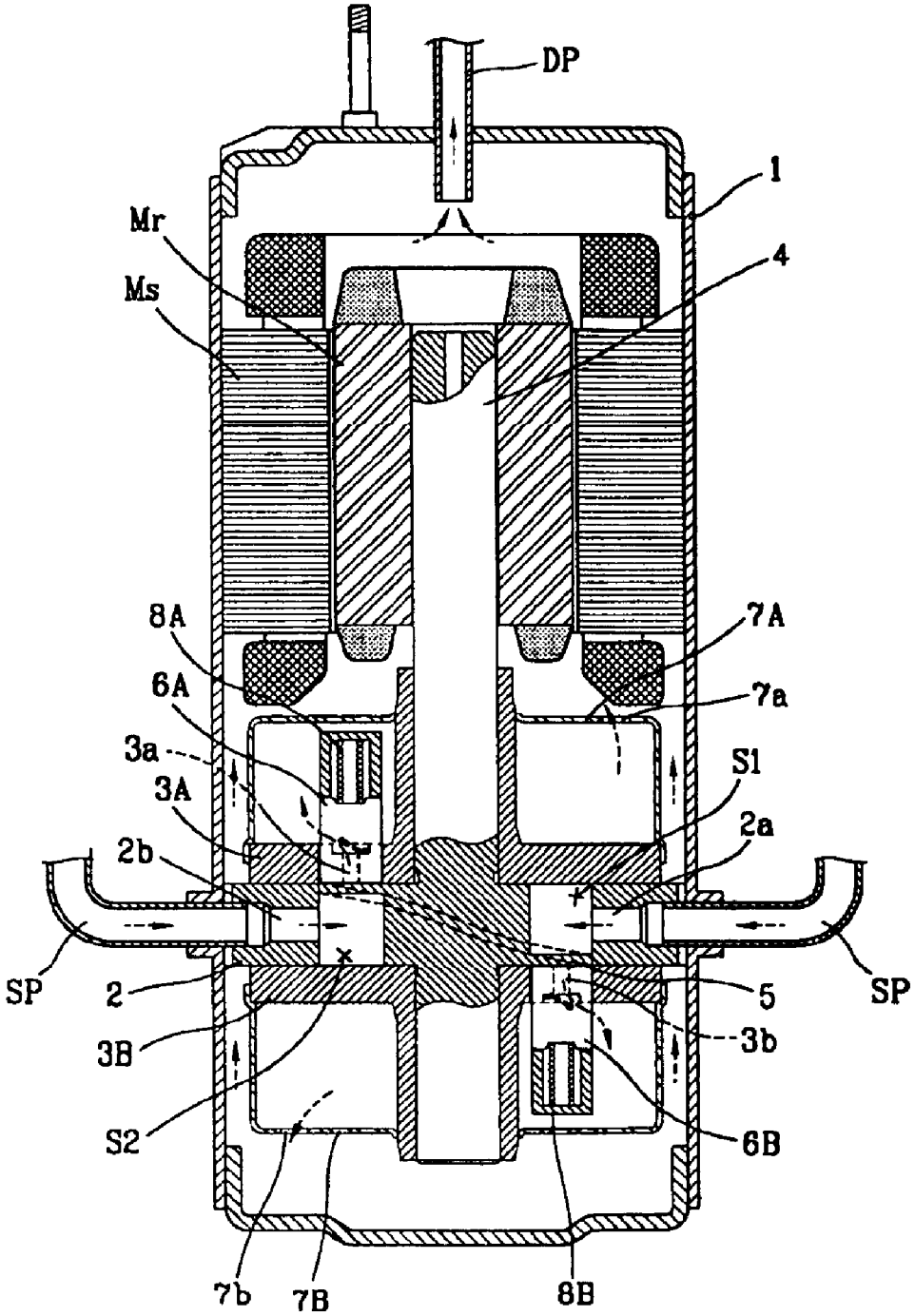
FIG. 1 CONVENTIONAL ART
FIG. 1 is a vertical-sectional view showing an example of a compression with a Z-plate in accordance with a conventional art.
Figure 2:
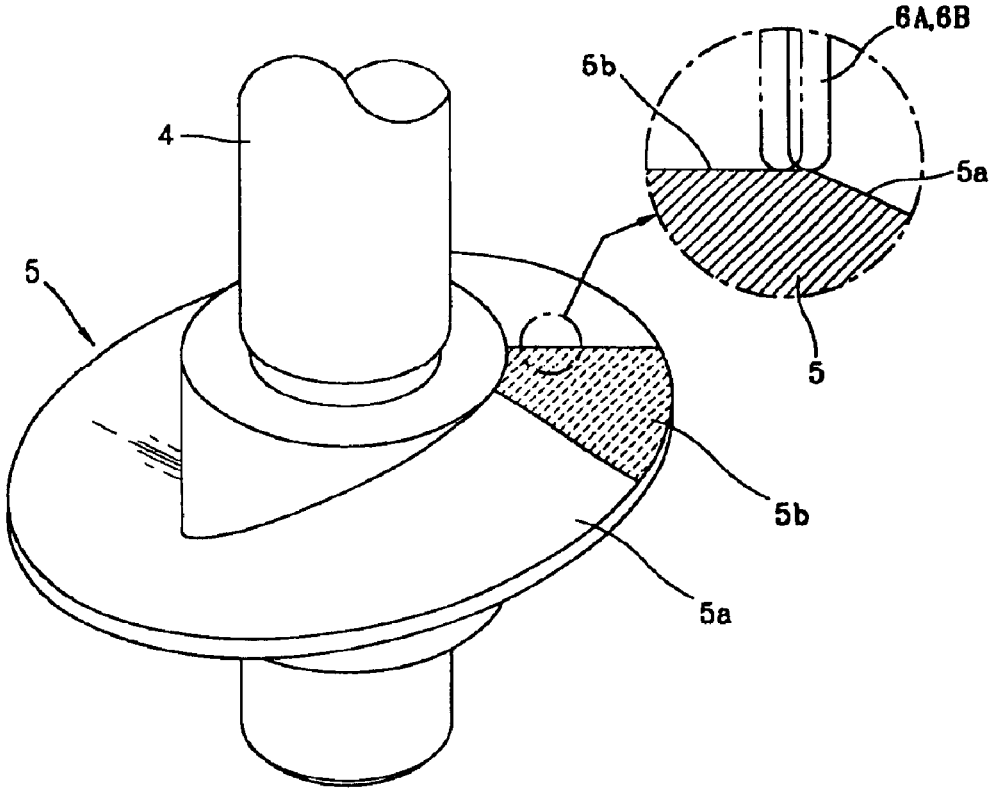
FIG. 2 CONVENTIONAL ART
FIG. 2 is a perspective view showing a Z-plate of the compressor of FIG. 1 and a sectional view of a major part.
Figure 3:
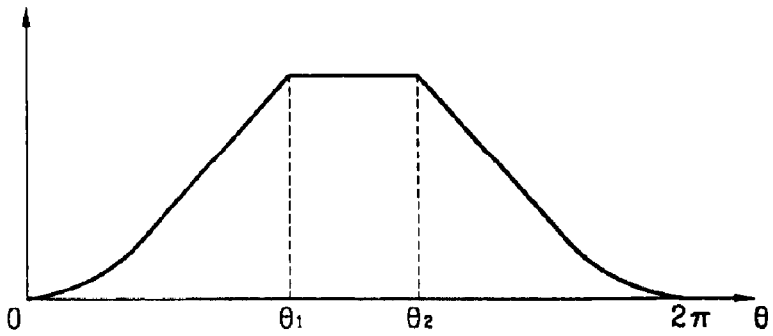
FIG. 3 CONVENTIONAL ART
FIG. 3 is a graph showing a development of a cam surface of the Z-plate of the compressor in accordance with the conventional art.

With reference to FIG. 1, a compressor with a Z-plate in accordance with the present invention includes: a cylinder 2 coupled at one side of an electric mechanism unit and fixed at a casing 1, first bearing plate 3A and second bearing plate 3B fixed at the an upper surface and a lower surface of the cylinder 2 and forming an inner space of the cylinder 2 together; a rotational shaft 4 coupled at the electric mechanism unit and penetratingly coupled to the bearing plates 3A and 3B so as to transfer a driving force of the electric mechanism unit to a compression mechanism unit; a Z-plate 10 (refer to FIG. 4) coupled at or integrally molded with the rotational shaft 4 and sectioning the inner space of the cylinder 2 into a first space S1 and a second space S2; and first and second vanes 6A and 6B being in contact in its lower end and its upper end with both sides of the Z-plate 10 and sectioning the spaces S1 and S2 into a suction area and a compression area when the rotational shaft 4 is rotated.

The compressor of the present invention has the same construction as that of the conventional compressor, except for the Z-plate 10 as shown in FIG. 4.

The Z-plate 10 is formed as a disk type in view of plane projection so that its outer circumferential face can slidably contact an inner circumferential face of the cylinder 2.

In addition, as shown in FIGS. 4 and 5, both sides of the Z-plate 10 are formed as a cam surface in a sine wave shape. Each cam surface includes a curved portion 11 implemented by a particular function from the lower dead point to certain intervals $(0\sim\theta_1)$ $(\theta_4\sim2\pi)$ of the both sides, a gentle portion 12 formed round from the curved portion 11 to a certain intervals $(\theta_1\sim\theta_2)$ $(\theta_3\sim\theta_4)$ of the both sides, and a plane portion 13 including an inflection point at the certain interval $(\theta_2\sim\theta_3)$ between both ends of the gentle portion 12.

With reference to FIG. 1, as for the first vane 6A and the second vane 6B formed as rectangular parallelepiped, its upper end is supported by spring assemblies 8A and 8B, and its lower end penetrates the bearing plates 3A and 3B and coupled to be in contact with the both upper and lower sides of the Z-plate 10.

For reference, the same reference numerals are given to the same elements as those in the conventional art.

The operation and effect of the compressor with the Z-plate of the present invention will now be described.

When power is applied to the electric mechanism unit, the rotational shaft 4 is rotated in one direction together with the Z-plate 10, according to which each capacity of the first space S1 and the second space S2 is varied and a fresh fluid is simultaneously sucked into each space, compressed and then discharged.

At this time, the vanes 6A and 6B being in contact with upper and lower sides of the Z-plate 10 are moved reciprocally in the opposite direction along the high and low of the Z-plate. In this respect, since the both cam surfaces of the Z-plate 10 includes the gentle portion 12 roundly connecting the curved portion 11 and the plane portion 13, as well as the curved portion 11 and the plane portion 13, the vanes 6A and 6B can slidably moved while maintaining the state of being in constantly contact with the cam surfaces of the Z-plate 10.

Therefore, an impact noise between the vanes 6A and 6B and the Z-plate 10 caused when the vanes 6A and 6B are abruptly detached from the Z-plate 10 and then attached back can be prevented. And since the connecting portion between the curved portion 11 and the plane portion 13 of the Z-plate 10 is formed round, the bearing faces of the bearing plates 3A and 3B where the Z-plate 10 slidably contacts can be prevented from being abraded by being scratched by the Z-plate.

Figure 6:
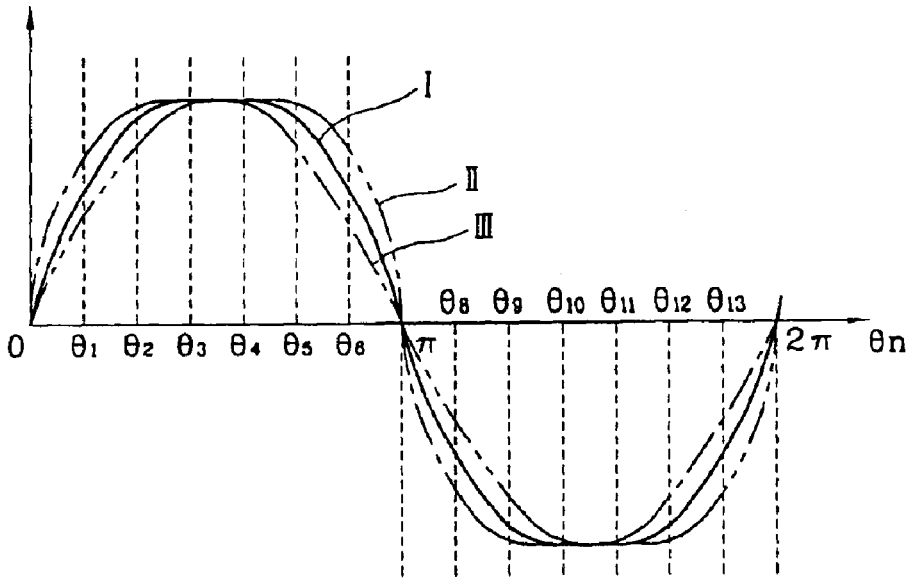
FIG. 6 is a graph showing that the cam surface of the Z-plate can be changed with diverse functions for implementation in the compressor with a Z-plate in accordance with the present invention.

Meanwhile, as shown in FIG. 6, the curved portion 11 and the gentle portion 12 can be successively combined by differentiating the function in every certain interval $(0\sim\theta_1)$ $(\theta_1\sim\theta_2)$, . . . , $(\theta_{12}\sim\theta_{13})$ $(\theta_{13}\sim2\pi)$.

That is, provided that the sine wave curved line corresponds to the curved line of 'I' in FIG. 6, the value of the function forming the curved surface can be set larger or smaller so as to becomes the curved line of 'II' or the curved line of 'III'.

At this time, the vanes 6A and 6B respectively being in contact with both upper and lower sides of the Z-plate 10 are moved reciprocally in the opposite direction along the high and low of the Z-plate 10. Thus, in case that both cam surfaces of the Z-plate 10 are formed such that every interval is formed to be curved symmetrically with combinations of different functions, a discharge initiation angle and compression process can be variably changed to be designed and a discharge pulsation noise can be reduced.

As so far described, the compressor with a Z-plate of the present invention has the following advantages.

That is, for example, since the region formed near the inflection point among the both sides being in contact with the vane, where the plane portion and the curved portion are connected to each other, is formed round, so that the vane is maintained in a state of constantly contacting the cam surface of the Z-plate. Thus, an impact noise caused between the vane and the Z-plate can be prevented in advance and abrasion from scratch on the bearing face of the bearing plate can be prevented, so that a compression performance can be satisfactorily maintained.

In addition, by forming the both cam surfaces of the Z-plate with combinations of different functions for intervals, a discharge initiation angle and compression process can be designed to be variably changed depending on a design conditions of a compressor in order to reduce a discharge pulsation and improve a compression performance.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such metes and bounds are therefore intended to be embraced by the appended claims.

What is claimed is:

1. A compressor, comprising:

a cylinder with a suction passage and a discharge passage;

a Z-plate configured to section an inner space of the cylinder into a plurality of compression spaces and to be rotated by a driving unit so that a fluid can be sucked, compressed and discharged; and vanes configured to move reciprocally due to contact with both sides of the Z-plate so as to section the compression space into a suction area and a compression area, wherein the Z-plate comprises a curved portion formed based on a particular function such that both sides make contact with a vane, a plane portion formed around an inflection point of the curved portion and including the inflection point, and a rounded portion formed between the curved portion and the plane portion.

2. The compressor of claim 1, wherein both sides of the Z-plate are configured so as to maintain substantially constant contact with the respective vanes.

3. A compressor, comprising:

a cylinder with a suction passage and a discharge passage;

a Z-plate configured to section an inner space of the cylinder into a plurality of compression spaces and to rotate in response to a driving force generated by a driving unit so that a fluid can be sucked, compressed and discharged; and vanes configured to move reciprocally based on contact with sides of the Z-plate so as to section the compression space into a suction area and a compression area, wherein a shape of curved portions of the Z-plate which contact the vanes are formed based on combinations of multiple functions.

4. The compressor of claim 3, wherein the Z-plate comprises:

a curved portion formed based on multiple functions such that both sides make contact with the respective vanes;

a plane portion formed around an inflection point of the curved portion and including the inflection point; and a rounded portion formed between the curved portion and the plane portion.

5. The compressor of claim 3, wherein the curved portions of the Z-plate which contact the respective vanes are contoured so as to allow a variation of a discharge initiation angle.

6. The compressor of claim 3, wherein both sides of the Z-plate are configured so as to maintain substantially constant contact with the respective vanes.

7. A compressor, comprising:

a cylinder with a suction passage an a discharge passage;

a Z-plate configured to section an inner space of the cylinder into a plurality of compression spaces and to rotate in response to a driving force generated by a driving unit so that a fluid can be sucked, compressed and discharged; and vanes configured to move reciprocally based on contact with respective sides of the Z-plate so as to section the compression space into a suction area and a compression area, wherein an upper dead center portion of the Z-plate is substantially planar, and a portion of the Z-plate which does not form the upper dead center portion is formed as a curved surface which is connected to the substantially planar upper dead center portion by a rounded transition portion.

* * * * *